United States Patent [19]

Toyoda et al.

[11] Patent Number: 4,475,807

[45] Date of Patent: Oct. 9, 1984

[54] CLEANING APPARATUS FOR XEROGRAPHIC PRINTING APPARATUS

[75] Inventors: Motoya Toyoda; Masayuki Ainoya; Hiroomi Kozawa; Shigenobu Katagiri, all of Ibaraki, Japan

[73] Assignee: Hitachi Koki Co., Ltd., Tokyo, Japan

[21] Appl. No.: 382,985

[22] Filed: May 28, 1982

[51] Int. Cl.[3] ..... G03G 21/00

[52] U.S. Cl. ..... 355/15; 15/256.52

[58] Field of Search ..... 355/3 R, 15; 15/256.52

[56] References Cited

U.S. PATENT DOCUMENTS

| | | | |
|---|---|---|---|
| 3,819,263 | 6/1974 | Draugelis et al. | 355/15 X |
| 3,850,521 | 11/1974 | Saupe | 355/15 |
| 3,942,889 | 3/1976 | Kurita et al. | 355/15 |
| 4,158,498 | 6/1979 | Ohmori | 355/15 |

*Primary Examiner*—Fred L. Braun

*Attorney, Agent, or Firm*—Sughrue, Mion, Zinn, and Macpeak

[57] ABSTRACT

A cleaning apparatus for a copier includes a photoconductor-cleaning rotating fur brush disposed within a housing. In order to prevent toner buildup and resultant flaking within the housing, the brush and housing are relatively movable so that the brush can periodically clean the housing.

5 Claims, 8 Drawing Figures

CLEANING APPARATUS FOR XEROGRAPHIC PRINTING APPARATUS

BACKGROUND OF THE INVENTION

This invention relates to a cleaning apparatus especially designed to eliminate the toner adhering to the photoconductor of a xerographic printing apparatus by means of a fur brush.

In a conventional cleaning apparatus, as shown in FIGS. 1 and 2, a fur brush 2 contacting the surface of a photoconductor 1 is driven by a brush motor 3 to remove residual toner T remaining on the photoconductor 1. A housing 4 is disposed in such a manner as to surround the fur brush 2 with an adequate clearance. The residual toner T removed by the fur brush 2 is sucked in the air flow generated by a suction blower B, passing through the housing 4 to a suction chamber 5, and is transported to a reclaiming system R.

With such a cleaning apparatus, however, if the speed of the air flow along the inner wall surface of the housing 4 is not sufficient, some of the reclaimed residual toner tends to adhere to the inner surface of the housing 4 and accumulate therein. The accumulated toner gradually increases in thickness, and when the cleaning apparatus is vibrated, the toner is stripped from the inner surface of the housing 4 to fall down. As this toner cannot be drawn off by the suction air flow, it falls down on the surface of the photoconductor 1, which causes poor printing. Therefore, the conventional cleaning apparatus requires frequent cleaning of the interior of the housing 4 before the toner is so stripped, and costs a great deal for maintenance.

SUMMARY OF THE INVENTION

It is, accordingly, an object of the present invention to overcome the above disadvantages and provide a cleaning apparatus which can prevent the accumulated toner adhering to the inner surface of the housing from falling on the photoconductor surface. The invention thus provides means for removing the accumulated toner on the inner surface of the housing by means of the above fur brush itself.

DETAILED DESCRIPTION OF THE PREFERRED EMBODIMENTS

Figure 1:
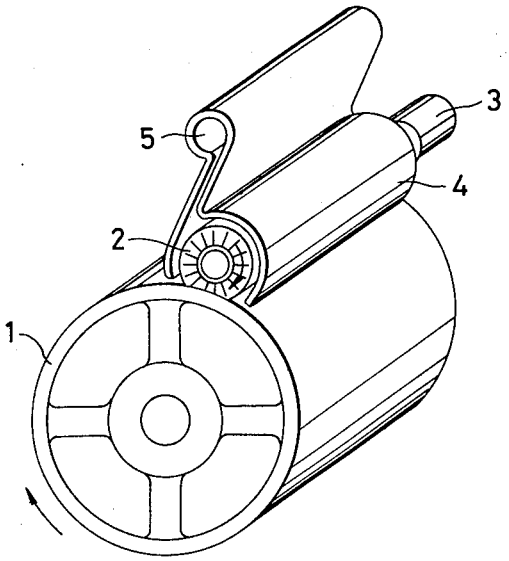
FIG. 1 PRIOR ART
FIG. 1 is a perspective view showing a conventional cleaning apparatus for a xerographic printing apparatus.
Figure 2:
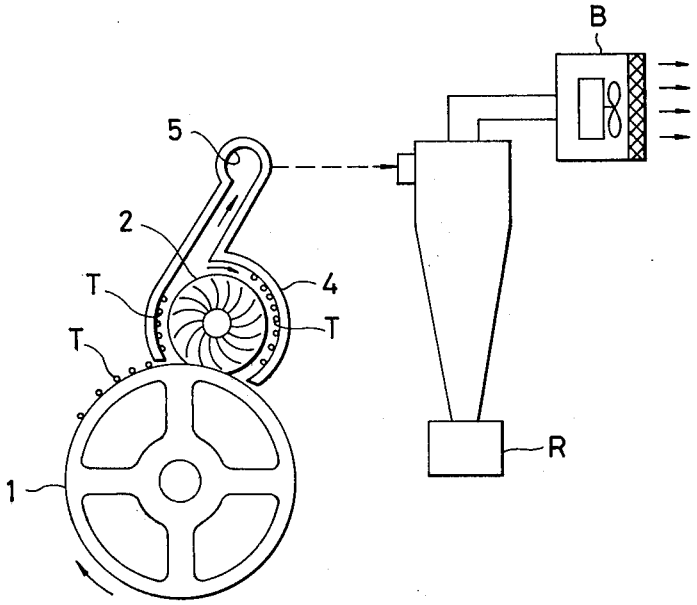
FIG. 2 PRIOR ART
FIG. 2 is a schematic side view of the apparatus of FIG. 1.
Figure 3:
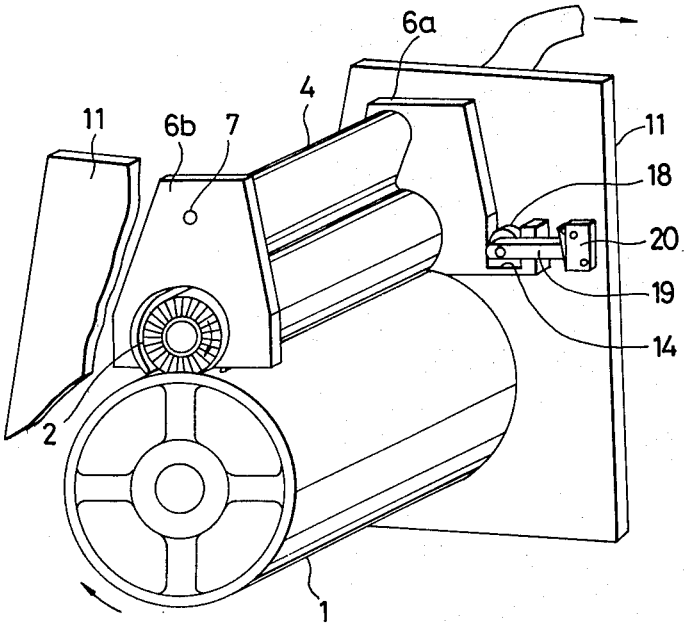
FIG. 3 is a perspective view showing one embodiment of the present invention.
Figure 4:
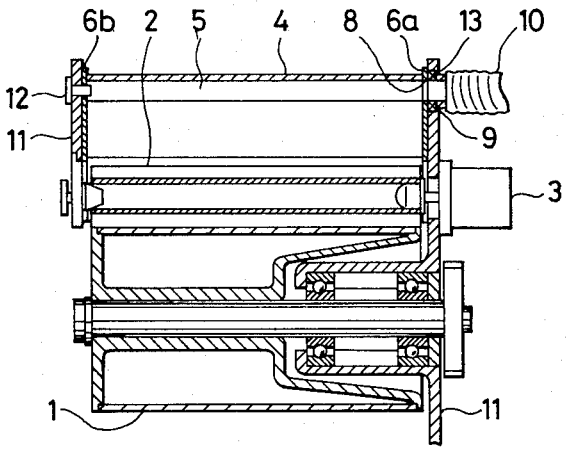
FIG. 4 is a longitudinal sectional view of the device of FIG. 3.
Figure 5:
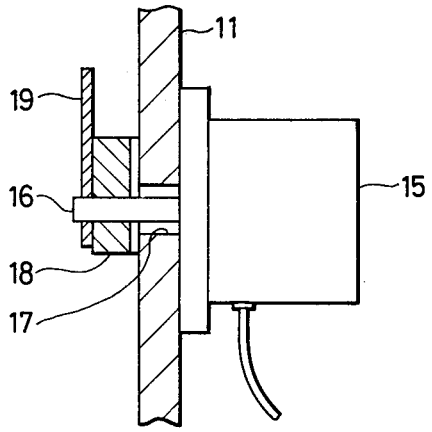
FIG. 5 is a longitudinal sectional view showing the cam driving portion.

The present invention will now be described by way of an illustrative embodiment thereof with reference to FIGS. 3–6. In FIGS. 3–5, a pair of side plates 6*a*, 6*b* are fixed to both ends of the housing 4 and the suction chamber 5. The surface of the side plate 6*b* opposed to the suction chamber 5 is provided with a through hole 7, and likewise the surface of the side plate 6*a* opposed to the suction chamber 5 is provided with a through hole 8 and a pipe joint 9 secured thereon, to which a pipe 10 connected to the reclaiming system R is coupled. The housing 4 is disposed inside of a pair of bases 11, and is pivotally supported by a pin 12 engaging the through hole 7 and the pipe joint 9 pivotally inserted into a through hole 13 provided on the base 11, with the shaft core of the suction chamber 5 centered.

The moving means for the housing 4 will be now described. The side plate 6*a* projects forwardly at the lower portion thereof, and forms an upwardly opened groove 14. A step motor 15 is fixed on the outside of the base 11 opposed to the groove 14, the shaft 16 of the motor being projected inside of the base 11 through a through hole 17 therein. The end portion of the shaft 16 is provided with an eccentric cam 18 and an actuator 19. The eccentric cam 18 is adapted to engage the groove 14 and the actuator 19 is adapted to actuate a detecting switch 20 mounted on the inside of the base 11. The detecting switch 20 is adapted to set the initial position of the step motor 15. The rotational angular control of the step motor 15 is achieved by applying driving pulse to the motor by means of an ordinary pulse control circuit (not shown).

Figure 6A:
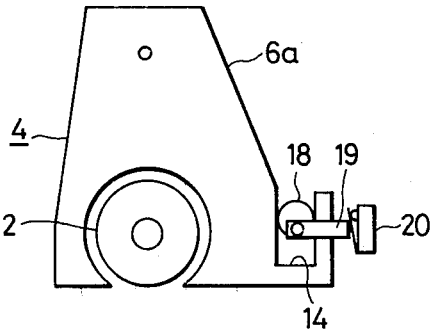
FIGS. 6(*a*)–6(*c*) are typical diagrams illustrating the operation of the moving means.
Figure 6B:
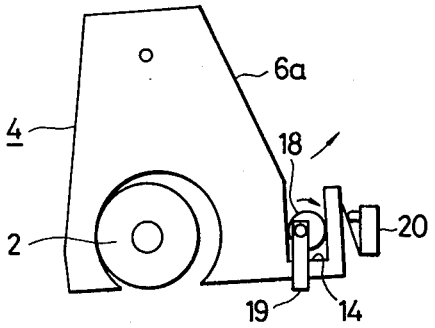
Figure 6C:
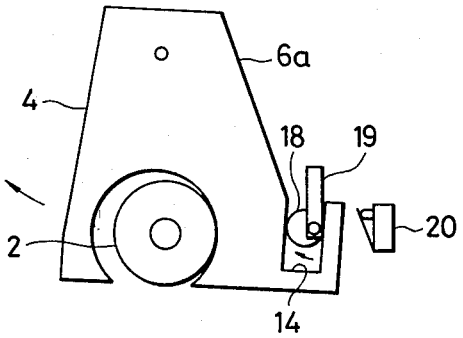

The operation of the above embodiment will now be described with reference to FIGS. 6(*a*)–6(*c*). In a normal operating condition, as illustrated in FIG. 6(*a*), the eccentric cam 18 is adapted to control the movement of the housing 4 in a manner such that the housing 4 and the fur brush 2 are uniformly spaced at the periphery thereof. In such a condition, the eccentric cam 18 is located at a neutral point, and the actuator 19 engages the detecting switch 20. When a driving signal is applied to the step motor 15 from a control device of the printing apparatus, the step motor 15 rotates clockwise, and the housing 4 moves in a clockwise direction as illustrated in FIG. 6(*b*). At this time, the step motor 15 is rotated until the fur brush 2 contacts the inner surface of the housing 4, the shaft 16 of the step motor 15 being stopped and retained at this position. In such condition, the fur brush 2 is rotated in a manner such that the accumulated residual toner T adhering to the left inner surface of the housing 4 is eliminated and sucked into the toner reclaiming system R with the air flow of the blower B.

After a fixed time, the brush motor 3 is stopped, the step motor 15 is further rotated clockwise, and the housing 4 is turned to the left as illustrated in FIG. 6(*c*), so that the fur brush 2 is brought into contact with the right inner surface of the housing 4 and retained at that position. Then, the fur brush 2 is rotated in a manner such that the accumulated residual toner T adhering to the right inner surface of the housing 4 is eliminated and sucked into the toner reclaiming system R.

Further, after a fixed time, the brush motor 3 is stopped and the step motor 15 is rotated clockwise and restored to the initial position and retained thereat. With the above, the cleaning process for the inside of the housing is completed, and is followed by a printing process.

Any means such as a cam mechanism, a gear mechanism, an electromagnetic solenoid or the like, can be adopted as the moving means. In the above embodiment, the fur brush is supported directly on the base relative to which the housing is moved, but an effective construction can also be had where the fur brush is pivotally hung and supported on the base so that the brush may be moved.

As described above, an advantage of this invention is that there is provided means for automatically eliminating the accumulated residual toner adhering to the inner surface of the housing, to thereby prevent poor printing caused by the dropping of residual toner onto the photoconductor surface.

What is claimed is:

1. In a cleaning apparatus for a xerographic apparatus having a fur brush for eliminating toner adhering to a photoconductor, a housing for storing the fur brush, and a suction device; the improvement comprising moving means for moving said fur brush and said housing relative to one another in a manner such as to bring said fur brush into contact with the inner surface of said housing, said brush being a rotary brush and being operable to remove toner accumulated within said housing and move the same toward said suction device.

2. A cleaning apparatus as claimed in claim 1, said moving means comprising means pivotally mounting said housing, and means for urging said housing against said brush.

3. A cleaning apparatus as claimed in claim 2, said housing being reciprocatingly pivotably moved by said urging means.

4. A cleaning apparatus as claimed in claim 2, said urging means including a step motor, a cam driven by said motor and a slot in a portion of said housing for receiving said cam.

5. A cleaning apparatus as claimed in claim 4, further including switch means operated by rotation of said cam.

* * * * *